United States Patent [19]

Sunami et al.

[11] 4,402,824

[45] Sep. 6, 1983

[54] PROCESS FOR REFINING COAL-BASED HEAVY OILS

[75] Inventors: Yoshihiko Sunami; Keiichi Sasaki; Tohru Iwahashi, all of Amagasaki, Japan

[73] Assignee: Sumitomo Metal Industries, Limited, Osaka, Japan

[21] Appl. No.: 247,332

[22] Filed: Mar. 25, 1981

[51] Int. Cl.[3] ..... C10C 1/18; C10C 3/00; C10G 21/16

[52] U.S. Cl. ..... 208/45; 208/304; 208/332

[58] Field of Search ..... 208/45, 309, 332

[56] References Cited

U.S. PATENT DOCUMENTS

| | | | |
|---|---|---|---|
| 1,905,423 | 4/1933 | Rhodes et al. | 208/45 |
| 2,159,444 | 5/1939 | McCluer et al. | 208/332 |
| 2,213,798 | 9/1940 | Anne | 208/309 |
| 2,250,991 | 7/1941 | Garofalo et al. | 208/45 |
| 2,453,933 | 11/1948 | Polizzoto et al. | 208/45 |
| 2,870,223 | 1/1959 | Webb et al. | 208/45 |
| 2,871,181 | 1/1959 | Kulik | 208/45 |
| 4,089,934 | 5/1978 | Akiyoshi et al. | 208/45 |

FOREIGN PATENT DOCUMENTS

| | | | |
|---|---|---|---|
| 738378 | 7/1966 | Canada | 208/309 |
| 2085761 | 12/1971 | France | 208/332 |
| WO81/01842 | 7/1981 | PCT Int'l Appl. | 208/332 |
| 1699370 | 11/1953 | United Kingdom | 208/45 |
| 1124204 | 8/1968 | United Kingdom | 208/45 |

*Primary Examiner*—Delbert E. Gantz
*Assistant Examiner*—Helane E. Maull
*Attorney, Agent, or Firm*—Watson, Cole, Grindle & Watson

[57] ABSTRACT

A coal-based heavy oil is refined so as to remove quinoline insolubles and provide a hydrocarbon product suitable for making carbon stocks by heating to remove the volatile components which have boiling points ranging from the initial boiling point of the heavy oil to up to at least 200° C. and at most 270° C., thereby leaving a residual coal-based heavy oil, the residual coal-based heavy oil is mixed with a ketone-type solvent having a boiling point less than 200° C. to form an insoluble precipitate (including quinoline insolubles) and a supernatent, the supernatent is treated to recover the ketone-type solvent, and the remaining hydrocarbon mixture is easily processed by vacuum distillation to produce a hydrocarbon product suitable for making carbon stocks.

9 Claims, 1 Drawing Figure

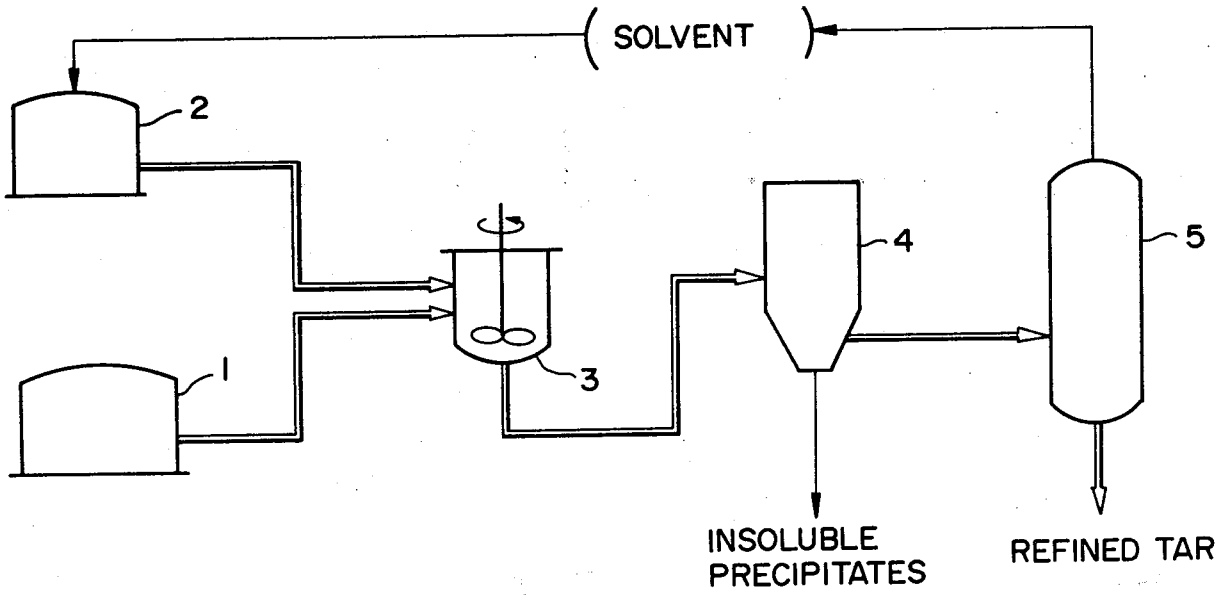
SOLVENT
2
1
3
4
5
INSOLUBLE PRECIPITATES
REFINED TAR

PROCESS FOR REFINING COAL-BASED HEAVY OILS

BACKGROUND OF THE INVENTION

1. Field of the Invention

The present invention relates to a process for refining coal-based heavy oils, and more generally to a process for treating coal-based heavy oils so as to produce hydrocarbon products which are suitable for the production of high-grade carbon stocks (such as readily graphitizable needle-shaped coke, isotropic carbon and high-grade activated carbon).

2. The Prior Art

Carbon stocks such as readily graphitizable needle-shaped coke, isotropic carbon and high-grade activated carbon are very useful, for example, in making ultra high power graphitic electrodes. In the past, carbon stocks have been produced from a great variety of raw materials, ranging from petroleum-based heavy oils and coal-based heavy oils to synthetic polymers. Petroleum-based heavy oils and coal-based heavy oils have been the most popular raw materials because of their low cost and high carbonization yields, the coal-based heavy oils in particular displaying especially high carbonization yields.

However, use of both petroleum-based heavy oils and coal-based heavy oils have their drawbacks. For example, since petroleum-based heavy oils from most sources contain sulfur, which is a very undesirable component, the number of sources capable of producing low sulfur-containing petroleum-based heavy oils are very limited. On the other hand, although coal-based heavy oils have very low sulfur contents and, as noted above, provide very high carbonization yields, they contain minute amounts of fine, inactive carbonaceous substances, especially quinoline insolubles which, if not removed, detrimentally affect the graphitizing properties of the coal-based heavy oils. This is especially undesirable when attempting to produce therefrom the so-called high-grade carbon stocks (containing needle-shake coke and isotropic carbon).

Methods have been devised for removing quinoline insolubles from conventional coal-based heavy oils so as to enable these heavy oils to produce high-grade carbon stocks. These methods can in fact be divided into four categories:

(1) methods which involve subjecting the coal-based heavy oils to a thermal treatment, thereby enlarging the particular diameters of the contained quinoline insolubles and facilitating separation thereof (for example, as disclosed by Japanese Patent Publication Nos. 32722/1972 and 4334/1958);

(2) methods which involve mixing the coal-based heavy oils with an organic solvent, thereby inducing precipitation of the contained insolubles (which include quinoline insolubles) and permitting separation thereof (for example, as disclosed by JA-OS No. 102303/1977), (3) methods which involve mixing the coal-based heavy oils with an aliphatic solvent, stirring the mixture at an elevated temperature, then allowing the stirred mixture to stand and cool, thereby inducing precipitation of the contained insolubles (which include quinoline insolubles) and permitting separation thereof (for example, as disclosed by Japanese Patent Publication No. 26481/1974 and JA-OS No. 98720/1976), and (4) methods which involve mixing the coal-based heavy oils with an aliphatic solvent and an aromatic solvent, thereby inducing precipitation of the contained insolubles (which include quinoline insolubles) and permitting separation thereof (for example, as disclosed by JA-OS No. 78201/1977).

Unfortunately, these known methods have not been found to be commercially feasible. With respect to the category (1) methods, since the precipitated insolubles therein have extremely small particle diameters, their separation proceeds at a low speed and with poor efficiency, and during separation the utilized filter will invariably become clogged. Further, since the coal-based heavy oil must be centrifuged or filtered at an elevated temperature (to cause it to exhibit a lowered viscosity), the operation entails expensive equipment and high costs of maintenance. With respect to the category (2) methods, since the amount of organic solvent used therein generally amounts to 10 to 100 times that of the coal-based heavy oils, these methods are very costly. Moreover, since the precipitated insolubles created by these methods have extremely small particle diameters, their separation is achieved with a very low efficiency. With respect to the category (3) methods, since the precipitation of insolubles therein generally occurs slowly at normal room temperature, it is necessary that the mixture of coal-based heavy oil and solvent be stirred for several hours at a temperature of not less than 200° C. and left to stand and cool until precipitation of insolubles occurs, followed by the separation of the precipitated insolubles. As a technique for the separation of precipitated insolubles, these methods are not suitable from the standpoint of both practical utility and operational efficiency. Finally, with respect to the category (4) methods, although the precipitated insolubles have relatively large particle diameters and efficient separation is achieved, the amounts of aromatic solvent and aliphatic solvent generally added in amounts is several times that needed to treat petroleum-based heavy oils. Since these added solvents are expensive, the treatment is not economical because of the cost of the devices needed to recycle the solvents. And even if the solvents are not recycled, the operation still proves uneconomical because the yields of carbonization are inevitably lowered. Moreover, since the heavy oil is mixed with two types of solvents, the equipment used must have a proportionately larger size for handling a fixed volume of heavy oil and, therefore, these methods prove less advantageous for commercialization. In addition, the quality control of the solvents, which is necessitated when the solvents are cyclically used, becomes difficult.

As described above, none of the methods so far proposed have proved commercially feasible for the removal of quinoline insolubles from conventional coal-based heavy oils.

It is an object of the present invention to provide a commercially acceptable method for refining coal-based heavy oils, i.e., so as to easily remove quinoline insolubles therefrom. It is furthermore an object of the present invention to provide a commercially acceptable method for treating coal-based heavy oils so as to produce hydrocarbon products suitable for the production of high-quality carbon stocks.

SUMMARY OF THE INVENTION

According to the present invention, the quinoline insolubles in coal-based heavy oils can be effectively removed therefrom by first providing a coal-based heavy oil from which the volatile components therein having boiling points of up to at least 200° C. and at most 270° C. have been removed (such treated coal-based heavy oils being hereinafter referred to as "residual coal-based heavy oils"), then mixing the residual coal-based heavy oils with ketone-type solvents to educe quinoline insolubles and gummy, tacky substances, then separating the insoluble precipitates from the supernatent, and then separating from the supernatent the utilized ketone-type solvents, thus leaving a hydrocarbon solution which is suitable for further processing into high-quality carbon stocks. The quinoline insolubles are easily removed from the supernatent becasue they will adhere to the gummy, tacky substances and increase their particle diameters, and the gummy, tacky substances will grow into a stable precipitate of coarser grains owing to the adhesion of the non-viscous quinoline insolubles.

The residual coal-based heavy oil of the inventive process is the heavy oil fraction which remains after the initial coal-based heavy oil raw material, e.g., a coal tar such as a high-temperature tar or a low-temperature tar produced as a biproduct during the carbonization of coal, or else a coal liquefaction product, has been treated to remove therefrom the volatile fraction composed of components which have boiling points of up to at least 200° C. and at most 270° C. In the preferred embodiment, the initial raw material is heated up from its initial temperature to a temperature of at least 200° C. and at most 270° C., most preferably 200° C. to 230° C., and the associated volatile components allowed to escape, thereby leaving a residual coal-based heavy oil according to the invention.

With respect to the foregoing, if the initial raw material is heated to less than 200° C. and only the volatile components therein removed which have boiling points less than 200° C., the remaining fraction, if used in the other steps of the inventive process, will require the use of greatly increased amounts of ketone-type solvent, the formed precipitate particles will have such small diameters (only tens of microns) that separation thereof from the supernatent will be difficult, and recovery of the ketone-type solvent hampered. On the other hand, if the initial raw material is heated to temperatures in excess of 270° C., such that the volatile components therein which have boiling points greater than 270° C. are removed, the remaining fraction, if used in the other steps of the inventive process, will produce large insoluble precipitates in the form of black, gummy, viscous materials which will clog the pipes and pumps of the equipment. In addition, some of the components intended to remain in the filtrate (pitch components) will precipitate, thus reducing the yield of the intended process.

The ketone-type solvents which are used in the invention for converting the finely divided quinoline insolubles contained in the residual coal-based heavy oil of the invention into coarser particles are hydrocarbon compounds having carbonyl groups in the molecular structure thereof. Examples of usable hydrocarbon compounds are acetone, methyl ethyl ketone, isopropyl methyl ketone, methyl propyl ketone, diethyl ketone, pinacolone, isobutyl methyl ketone, diisopropyl ketone, methyl butyl ketone and butyrone; methyl vinyl ketone, mesityl oxide and methyl heptanone; cyclopentanone and cyclohexanone; and ethyl amyl ketone and hexyl methyl ketone; and various combinations thereof. In order to be readily separated from the residual coal-base heavy oils by distillation once the quinoline insolubles have been removed therefrom, the ketone-type solvent used will desirably have a boiling point of less than 200° C., preferably below 100° C. When the ketone-type solvent has a boiling point of not less than 200° C., the separation of this solvent from the residual coal-based heavy oil (from which the insoluble quinolines have been removed) is difficult. Consequently, it is undesirably difficult to utilize such solvents in a cyclic process as desired.

The mixing together of the residual coal-based heavy oil of the invention and the ketone-type solvent is sufficiently effected when conducted at room temperature and at atmospheric pressure—the application of heat is not required. Stirring of the mixture is continued until the insoluble precipitate, which will include quinoline insolubles, is separated out in the form of a stable granular solid. Normally, the insoluble precipitate, including quinoline insolubles, is converted into readily separable coarse solid particles in a matter of a few minutes.

The amount of the ketone-type solvent to be added to the residual coal-based heavy oil of the invention is between 10 and 60%, preferably between 30 and 50%, by weight, based on the weight of the total mixture. When this amount exceeds 60%, the insoluble precipitate is converted into a gummy viscid substance which lacks fluidity, which substance will adhere to the equipment (or clog the piping), and will generally obstruct the smooth operation of the equipment. Further, because the precipitate occurs in an excess amount relative to that of the initial residual coal-based heavy oil, even the components expected to remain in the filtrate will be removed as extraneous matter in conjunction with the precipitate, with the result that the yield of the process will be lowered. On the other hand, when the amount is less than 10%, the resultant insoluble precipitate in the form of finely divided particles occurs in a very small amount, making its separation from the supernatent difficult. The fact that the removal of the quinoline insolubles is advantageously accomplished by use of a very small amount of the keton-type solvent constitutes itself one of the characteristic features of the process of this invention.

Since the granular solid formed in accordance with the process of this invention possesses a large particle diameter and, therefore, permits the precipitation to proceed at a high speed, the separation of the solid precipitate is readily accomplished by quiescent standing or centrifugation. When the separation is made by filtration, since the solid particles have large diameters, the passage of the filtrate through the filter proceeds smoothly without causing clogging. Thus, the solid particles can be separated quickly. The various methods of separation just described above may adopted in various suitable combinations. On the other hand, with conventional processes, the mixture which is subjected to separation must be treated at an elevated temperature or under increased pressure to lower the viscosity of the raw material and facilitate the separation. The process of the present invention has an advantage that the residual coal-based heavy oil of the invention has its viscosity lowered by the addition of the low-boiling ketone-type solvent, thus the separation of the insoluble precipitate is thoroughly carried out without requiring application of heat to the mixture which is to be separated.

After the insoluble precipitate, which includes finely divided quinoline insolubles originally contained in a very low concentration in the residual coal-based heavy oil of the invention, has been separated out as described above, the solvent remaining in the resultant mixed solution filtrate can be easily separated by distillation because the solvent component itself has a low boiling point and the heavy oil component does not contain any volatile components which will have boiling points up to between 200° C. and 270° C., preferably up to between 200° C. and 230° C. Thus, the solvent can be easily recovered and returned to a storage tank for cyclic use. The remaining hydrocarbon product is suitable for further treatments so as to manufacture high-grade carbon stocks. The process of this invention will now be further illustrated by reference to the accompanying FIGURE and the following working examples and comparative experiments.

DESCRIPTION OF THE FIGURE

The FIGURE shows a flow chart for treating a residual coal-based heavy oil according to the invention to remove quinoline insolubles therefrom and to recover the utilized solvent, thereby resulting in a hydrocarbon product suitable for forming carbon stocks.

Depicted in the FIGURE is a storage tank 1 which contains a residual coal-based heavy oil obtained according to the invention and a storage tank 2 containing a ketone-type solvent. The residual coal-based heavy oil and the ketone-type solvent are conveyed to a stirring tank 3 where they are combined and mixed, and the resultant mixture then conveyed to a separator 4 where the insoluble precipitates (including quinoline insolubles) are separated from the supernatent or filtrate (the precipitates being removed from the bottom of the separator). The filtrate is then conveyed to a recovery tower 5 where it is treated so as to recover the desired hydrocarbon product (refined tar) and solvent, the solvent being returned to tank 2.

EXAMPLE 1

A coal-based heavy oil in the form of coal tar containing 3.6% of quinoline insolubles and possessing the attributes shown in Table 1 was heated to 270° C. so as to remove the volatile components having boiling points of up to 270° C. A residual coal-based heavy oil was left. The residual coal-based heavy oil was then mixed at room temperature and atmospheric pressure with an equal amount by weight of methyl ethyl ketone having a boiling point of about 80° C. A dark brown, granular solid measuring about 1.0 mm in particle diameter was educed. When the mixed solution was passed through a net of 0.25-mm mesh at room temperature to separate out the granular solid, the granular solid could be separated to an amount of 5.6%, based on the initial weight of the residual coal-based heavy oil.

The filtrate remaining after the separation of the granular solid was distilled under atmospheric pressure to recover the methyl ethyl ketone. The remaining solution was then distilled under a vacuum to expel the oil fraction boiling at temperatures with the range of from 270° C. to 350° C. (calculated for atmospheric pressure) and a black pitch remained. As is seen from the attributes shown in Table 1, the pitch had excellent qualities and was perfectly free of quinoline insolubles.

COMPARATIVE EXPERIMENT 1

When 10% by weight of the same residual coal-based heavy oil used in Example 1 was mixed and stirred at room temperature and at atmospheric pressure with 90% by weight of pyridine having a boiling point of about 116° C., there ensued no recognizable eduction of any insoluble precipitate. When the resultant mixed solution was filtered as in Example 1, there ensued no separation of any solid. Thus, it was difficult to separate the quinoline insolubles by filtration. The pitch which was obtained by concentrating the filtrate in the same manner as in Example 1 exhibited attributes as indicated in Table 1. From the table, it is seen that quinoline solubles were contained therein.

TABLE 1

| | | | Raw Material | Example 1 | Comparative Experiment 1 |
|---|---|---|---|---|---|
| Mixing ratio (%) | Residual coal-based heavy oil | | 100 | 50 | 10 |
| | Methyl ethyl ketone | | — | 50 | — |
| | Pyridine | | — | — | 90 |
| Yield of granular solid recovered (%) | | | — | 5.6 | 0 |
| Attributes of raw material and pitch | Insolubles content in solvent (%) | n-Heptane insolubles | 32.4 | 68.5 | 70.0 |
| | | Benzene insolubles | 9.1 | 21.9 | 22.7 |
| | | Quinoline insolubles | 3.6 | 0 | 4.8 |
| | Softening point (°C.) | | 22 | 72 | 76 |
| Yield of Pitch (%) | | | — | 60 | 66 |

EXAMPLE 2

A coal-based heavy oil in the form of coal tar containing 3.2% of quinoline insolubles and possessing the attributes shown in Table 2 was heated to a temperature of 230° C. so as to remove the volatile components having boiling points of up to 230° C. A residual coal-based heavy oil was left. 60% by weight of the residual coal-based heavy oil and 40% by weight of acetone having a boiling point of 56° C. were combined and stirred at room temperature and atmospheric pressure. A dark brown, granular solid similar to the granular solid of Example 1 was educed. When the resultant mixed solution was treated in a centrifugal separator capable of 2000 G for one minute to separate the granular solid, there was obtained a granular precipitate in a yield of 4.7% based on the residual coal-based heavy oil used as the raw material.

The supernatant was distilled under atmospheric pressure to recover acetone. The remaining solution was then distilled under a vacuum to separate a fraction boiling at temperatures within the range of from 230° C. to 350° C. and a black pitch was obtained. This pitch exhibited attributes as shown in Table 2. From the table, it is seen that this pitch contained absolutely no quinoline insolubles.

COMPARATIVE EXPERIMENT 2

At normal room temperature and at atmospheric pressure, 30% by weight of the same residual coal-based heavy oil used in Example 2 and 70% by weight of benzene having a boiling point of 80% were mixed and stirred. When the resultant mixed solution was centrifuged under the same conditions as in Example 2, there was obtained an insoluble precipitate in a yield of 0.3% based on the residual coal-based heavy oil as the raw material. The supernatant was distilled under atmospheric pressure to recover benzene. When the remaining solution was concentrated in the same manner as in Examples 1 and 2, there was obtained a black pitch. This pitch exhibited attributes shown in Table 2. It is seen from this table, the pitch contained quinoline insolubles.

TABLE 2

| | | | Raw Material | Example 2 | Comparative Experiment 2 |
|---|---|---|---|---|---|
| Mixing ratio (%) | Residual coal-based heavy oil | | 100 | 60 | 30 |
| | Acetone | | — | 40 | — |
| | Benzene | | — | — | 70 |
| Yield of precipitate (%) | | | — | 4.7 | 0.8 |
| Attributes of raw material and pitch | Insolubles content in solvent (%) | n-Heptane insolubles | 29.8 | 69.7 | 70.3 |
| | | Benzene insolubles | 4.5 | 22.3 | 23.1 |
| | | Quinoline insolubles | 3.2 | 0 | 3.5 |
| | Softening point (°C.) | | 6 | 73 | 75 |
| Yield of Pitch (%) | | | — | 53 | 58 |

As is evident from the working examples cited above, the separation of quinoline insolubles by filtration which has been heretofore found difficult to achieve can be effectively carried out by the process of this invention with a net of about 0.25-mm mesh without causing the phenomenon of clogging. Thus, the removal of quinoline insolubles can be accomplished very easily. Also by means of centrifugation, the removal of quinoline insolubles can be obtained quickly with a low centrifugal force. The process of this invention is highly advantageous for the purpose of commercial refinement of coal-based heavy oil.

EXAMPLE 3

A liquefaction product boiling at temperatures of not less than 230° C. obtained by extraction of coal with a solvent contained 12% quinoline insolubles such as undissolved coal and ashes as shown in Table 3.

When 65% by weight of this liquefaction product and 35% by weight of isopropyl methyl ketone having a boiling point of 95% were mixed and stirred at 60% for 30 minutes, there was educed a dark brown granular solid. When the resultant mixed solution was allowed to stand and cool, the granular solid settled to the bottom. When the supernatant was separated by decantation, the sediment was obtained in a yield of 18% by weight based on the liquefaction product. The liquefaction product remaining after the removal of the sediment was distilled to recover isopropyl methyl ketone. It was further distilled under a vacuum to recover fractions boiling up to 450° C. (as computed for atmospheric pressure). Consequently, a black pitch was obtained in a yield of 32% by weight based on the liquefaction product as the raw material. This black pitch exhibited attributes shown in Table 3. It is seen from the table that it was completely free of quinoline insolubles.

COMPARATIVE EXPERIMENT 3

Under the same conditions as in Example 3, the same liquefaction product of coal and about twice as much isopropyl methyl ketone were mixed, stirred, allowed to stand and cool off. Consequently, a black gummy viscous matter firmly attached to the agitation blades and within the stirrer. After the supernatant of the mixed solution was separated by decantation, the viscous matter was obtained in a yield of 32% by weight based on the liquefaction product as the raw material.

When the supernatant was distilled in the same manner as in Example 3, a black pitch was obtained in a yield of 14% by weight based on the raw material.

This pitch exhibited attributes as shown in Table 3.

From the working examples, it is found that the insoluble precipitates separated by the process of the present invention were in the form of coarse, non-viscous grains that were easily settled. Since the components of the coal-based heavy oil to be desirably retained in the filtrate were not precipitated, the yield was increased over the yields obtained in the comparative experiments involving the removal of gummy, viscid matter. Moreover, the quinoline insolubles were removed in the form of precipitates. All these results indicate that the process of this invention suits commercial applications.

TABLE 3

| | | | Raw Material | Example 3 | Comparative Experiment |
|---|---|---|---|---|---|
| Mixing Ratio (%) | Residual coal-based heavy oil | | 100 | 65 | 30 |
| | Isopropyl methyl ketone | | — | 35 | 70 |
| Yield of precipitate (%) | | | — | 18 | 32 |
| Attributes of raw material and pitch | Insolubles content in solvent (%) | n-Heptane insolubles | 41 | 76 | 71 |
| | | Benzene insolubles | 22 | 32 | 21 |
| | | Quinoline insolubles | 12 | 0 | 0 |
| | Softening point (°C.) | | 45 | 105 | 70 |
| Yield of Pitch (%) | | | — | 32 | 14 |

We claim:

1. A process for refining coal-based heavy oils which consists essentially of (a) providing a residual coal-based heavy oil which has been freed of volatile components having boiling points up to at least 200° C. and not more than 270° C., (b) mixing the residual coal-based heavy oil of step (a) with a solvent to form an insoluble precipitate and a supernatent, said solvent consisting of a ketone-type solvent having a boiling point of less than 200° C., said ketone-type solvent consisting of hydrocarbon compounds having carbonyl groups in their molecular structures, said ketone-type solvent being used in an amount of from 10 to 60% by weight of the total weight of ketone-type solvent and residual coal-based heavy oil, and said insoluble precipitate being in the form of coarse particles which have quinoline insolubles from the coal-based heavy oil adhered thereto, (c) separating the insoluble precipitate of step (b) from the supernatent, (d) treating the supernatent of step (c) to remove the ketone-type solvent, thereby leaving a hydrocarbon mixture which can be vacuum distilled to provide a hydrocarbon product suitable for making high-quality carbon stocks.

2. The process according to claim 1, wherein said residual coal-based heavy oil of step (a) is provided by heating a coal-based heavy oil to a temperature of between 200° C. and 270° C. and allowing the volatile components to escape therefrom.

3. The process according to claim 2, wherein said coal-based heavy oil is heated to a temperature of between 200° C. and 230° C. such that residual coal-based heavy oil has been freed of volatile components having boiling points between the boiling point of the heavy oil and up to not less than 200° C. and not more than 230° C.

4. The process according to claim 2, wherein said coal-based heavy oil is coal tar.

5. The process according to claim 2, wherein said coal-based heavy oil is a coal liquefaction product.

6. The process according to claim 1, wherein said ketone-type solvent is at least one member selected from the group consisting of acetone, methyl ethyl ketone, isopropyl methyl ketone, methyl propyl ketone, diethyl ketone, pinacolone, isobutyl methyl ketone, diisopropyl ketone, methyl butyl ketone, butyrone, methyl vinyl ketone, mesityl oxide, methyl heptanone, cyclopentanone, cyclohexanone, ethyl amyl ketone and hexyl methyl ketone.

7. The process according to claim 2, wherein said ketone-type solvent has a boiling point of not more than 100° C.

8. The process according to claim 1, wherein the amount of ketone-type solvent used in step (b) is from 30 to 50% by weight of the total weight of ketone-type solvent and residual coal-based heavy oil.

9. The process according to claim 2, wherein said hydrocarbon mixture of step (d) is vacuum distilled to provide a hydrocarbon product suitable for making high-quality carbon stocks.

* * * * *